United States Patent [19]

Meszaros

[11] Patent Number: 5,072,976

[45] Date of Patent: Dec. 17, 1991

[54] LOCKING ACCESSORY

[76] Inventor: Steve P. Meszaros, 413 Bromley Street, Coquitlam, B.C., Canada, V3K 6N7

[21] Appl. No.: 635,901

[22] Filed: Dec. 28, 1990

[51] Int. Cl.[5] ..... E05C 3/04; E05B 13/02

[52] U.S. Cl. ..... 292/207; 292/359; 292/150

[58] Field of Search ..... 292/150, 359, 153, 207, 292/210, 179, 180; 70/416, 483, 487, 467

[56] References Cited

U.S. PATENT DOCUMENTS

| | | | |
|---|---|---|---|
| 59,076 | 10/1866 | Richardson | 292/359 |
| 396,571 | 1/1889 | Iddings et al. | 292/359 |
| 666,800 | 1/1901 | Chase | 292/359 |
| 956,947 | 5/1910 | Curlett | 292/359 |
| 1,348,047 | 7/1920 | Peterson et al. | 292/359 |
| 1,681,147 | 8/1928 | Dexter | 292/359 |
| 1,760,394 | 5/1930 | Best et al. | 292/359 |
| 2,733,089 | 1/1956 | Grevengoed | 292/207 |
| 2,851,871 | 9/1958 | Newell | 292/359 |
| 2,929,651 | 3/1960 | Friedman et al. | 292/207 |

FOREIGN PATENT DOCUMENTS

| | | | |
|---|---|---|---|
| 496746 | 10/1953 | Canada | 292/359 |
| 7463 | of 1889 | United Kingdom | 292/359 |
| 2377 | of 1905 | United Kingdom | 292/359 |
| 379466 | 9/1932 | United Kingdom | 292/359 |
| 886906 | 1/1962 | United Kingdom | 292/359 |

*Primary Examiner*—Gary L. Smith
*Assistant Examiner*—Darnell M. Boucher
*Attorney, Agent, or Firm*—Townsend and Townsend

[57] ABSTRACT

For use with a deadbolt lock having an actuating knob, a lock plate and a tailpiece engaging the actuating knob, a lock accessory comprises an intermediate plate for location between the lock plate and a door on which the lock is provided. The intermediate plate has an opening through which the tailpiece extends and a manually actuatable locking member mounted on the intermediate plate for selectively preventing and permitting rotation of the tailpiece. The locking member is displaceable into a first position, in which the locking member is in locking engagement with the tailpiece, and a second position, in which the locking member is displaced out of locking engagement with the tailpiece, and has a portion which can be manually engaged for effecting the displacement of the locking member between the first and second positions.

3 Claims, 2 Drawing Sheets

Fig. 1.
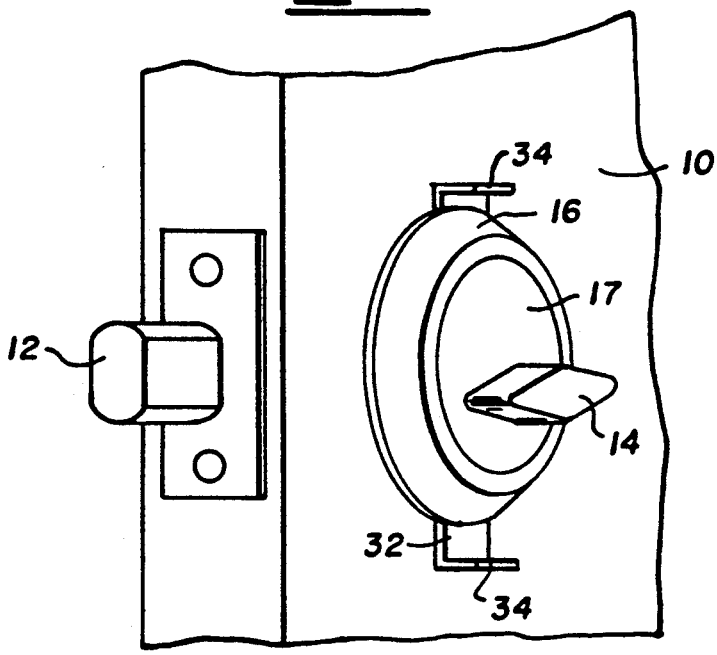
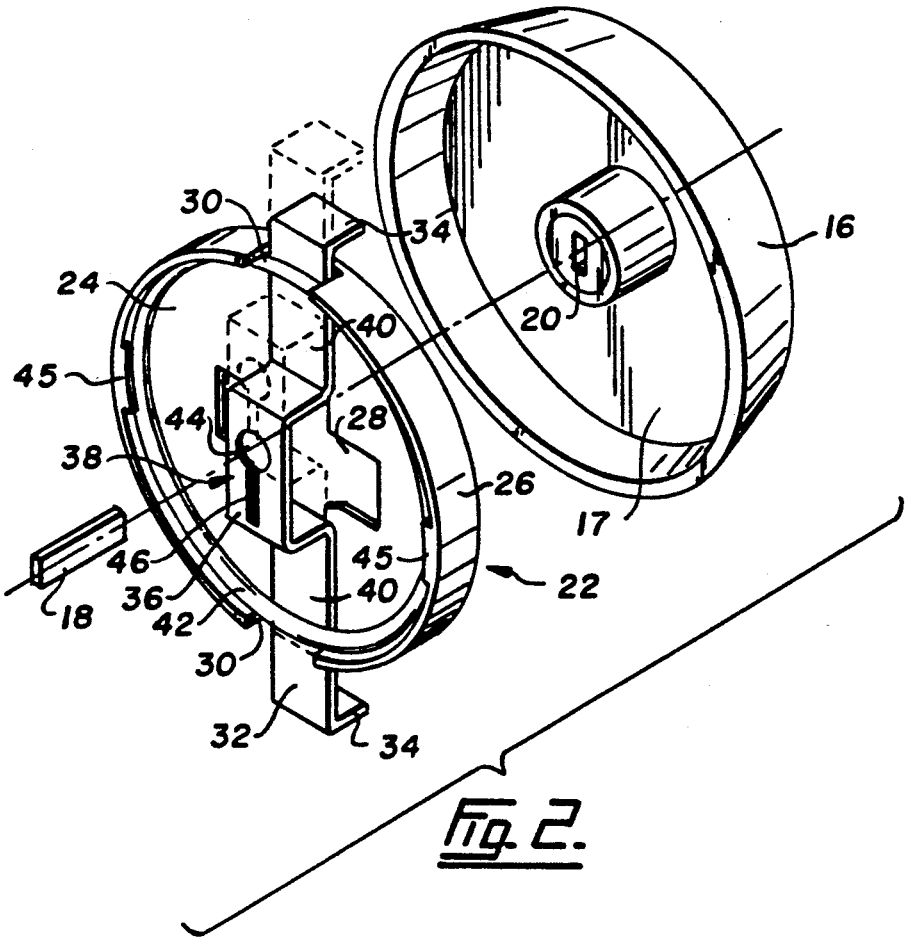
Fig. 2.

LOCKING ACCESSORY

FIELD OF THE INVENTION

The present invention relates to a lock accessory for use with a conventional residential deadbolt lock.

BACKGROUND OF THE INVENTION

It is desirable to be able to secure a door, from the interior side of the door, even when the door is locked by means of a deadbolt. This requirement results from the fact that, even when doors are locked in this manner, there is a risk that an unauthorized intruder may obtain possession of a key, which would enable him to release the lock from the exterior of the door.

It is, therefore, conventional to provide, on the inside of a door, one or more bolts, in addition to a deadbolt lock, so that the door can be secured against such an intruder. However, the addition of such bolts is difficult, especially on metal doors and frames, and inconvenient in that the bolts are sometimes unsightly and/or inconvenient to operate and/or costly.

It is, therefore, desirable to be able to lock the deadbolt from the interior side of the door and in such a manner that the deadbolt cannot be released by a key from the exterior of the door.

In Canadian Patent 496,746 issued Oct. 13, 1953, there is disclosed an auxiliary locking means for use in conjunction with a lock knob spindle for the actuation of a spring bolt in a standard door lock. The locking means comprises a flat latch plate member which is located at the interior side of the door surface and which is provided with central hole through which passes the lock knob spindle, which is square. The central hole in the latch plate has two communicating portions, one of which is circular in outline and the other of which has a substantially rectangular outline. The spindle can rotate in the circular portion but, when located in the other portion, is held against rotation by the latch plate member. The latch plate member can be slid to and for to locate the spindle in either of these portions and, thus, to lock and unlock the square spindle.

Australian Patent 147,426 issued Jan. 3, 1949, also discloses a latch mechanism which enables a doorknob spindle to be releasibly locked by the sliding displacement receiving the spindle.

A further example of such a locking mechanism is disclosed in U.S. Pat. Nó. 2,929,651 issued Mar. 22, 1960 to P. Friedman et.al., which is intended for storm doors.

BRIEF SUMMARY OF THE INVENTION

It is an object of the present invention to provide an accessory which can be added to a conventional deadbolt lock to enable the lock to be locked at the interior of a door so that it cannot be opened by a key from the exterior of the door.

According to the present invention, there is provided in a lock accessory for a deadbolt lock having an actuating knob, a lock plate and a tailpiece engaging the actuating knob. The lock accessory comprises an intermediate plate for location between the lock plate and a door on which the lock is provided, means defining in the intermediate plate an opening through which the tailpiece extends, and manually actuatable locking means mounted on the intermediate plate for selectively preventing and permitting rotation of the tailpiece. The locking means comprise a locking member displaceable into a first position in which the locking member is in locking engagement with the tailpiece, and a second position in which the locking member is displaced out of locking engagement with the tailpiece. Manually engageable means effect the displacement of the locking member between the first and second positions.

BRIEF DESCRIPTION OF THE DRAWINGS

Further features, objects and advantages of the present invention will be more readily apparent from the following description of two embodiments thereof illustrated, by way of example, with reference to the accompanying drawings, in which:

FIG. 1 shows a view in perspective of parts of a conventional deadbolt lock provided with a lock accessory according to the present invention;

FIG. 2 shows an exploded view, in perspective, of parts of the lock and the lock accessory of FIG. 1.

THE PREFERRED EMBODIMENTS

Figure 3:
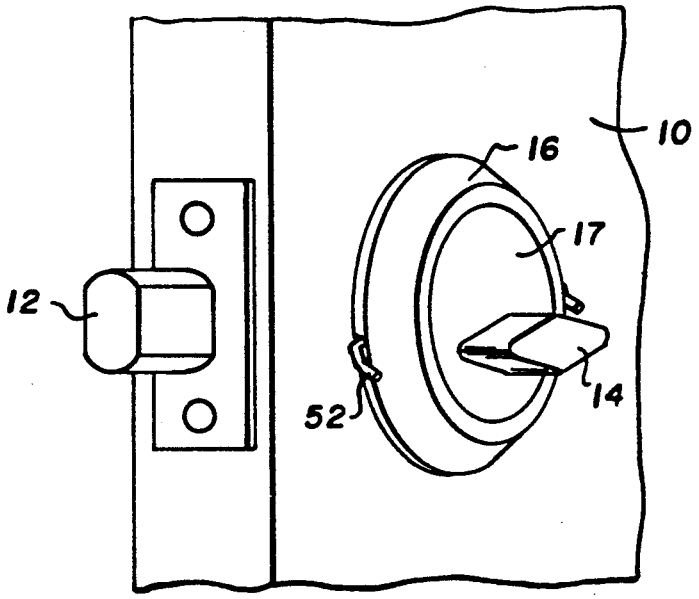
FIGS. 3 and 4 show views corresponding to those of FIGS. 1 and 2, but of a modified lock accessory.

In FIG. 1, there is shown a door 10 provided with a deadbolt 12, which is actuated by means of a lock having, at the inside of the door, a knob 14 and a housing 16 comprising a lock plate 17. The lock includes a flat tailpiece 18, which extends through the door into engagement with a recess 20 in the knob 14, the tailpiece 18 extending from a conventional lock barrel (not shown) which can be actuated from the exterior of the door by means of a key. The deadbolt 12, as described above, is of conventional design and manufacture.

In order to provide means for securing the lock, from the interior side of the door 10, against being released by use of a key at the exterior of the door, the present invention provides a lock accessory indicated generally by reference numeral 22 in FIG. 2.

The lock accessory 22 comprises a circular intermediate plate 24, with an integral annular skirt 26, which is interposed between the lock housing 16 and the interior side of the door 10 and which conforms in size to the periphery of the housing 16.

A cruciform opening 28 is formed in the plate 24, and the skirt 26 is formed with a pair of opposed cutouts 30 for receiving therethrough a slide member 32.

The slide member 32 has bent end portions 34 forming finger grips, a U-shaped raised central portion 36 formed with an keyhole-shaped opening, indicated generally by reference numeral 38, and flat intermediate portions 40 between the U-shaped raised portion 36 and the end portions 34. The flat portions 40 are in face-to-face contact with the plate 24 and are resiliently retained in position by means of an annular spring 42, which is retained at the inner side of the skirt 26 by means of inwardly extending upsets or projections 45 on the inner side of the skirt 26. The flat portions 40 of the slide member 32 are, thus, resiliently and slidably retained between the spring 42 and the plate 24.

The keyhole-shaped opening 38 has a circular portion 44, in which the tailpiece 18 can rotate when the tailpiece 18 -is located in the circular portion 44, and a slot-shaped portion 46, in which the tailpiece 18 is restrained from rotation when the tailpiece 18 is located in the slot-shaped portion 46. By means of the finger grips 34, the slide member 32 can be displaced manually to and from to locate the tailpiece 18 in the circular opening 44 to release the tailpiece 18 for rotation, and to locate tailpiece 18 in the slot 46 to retain the tailpiece from rotation and, thus, to keep the door locked.

Figure 4:
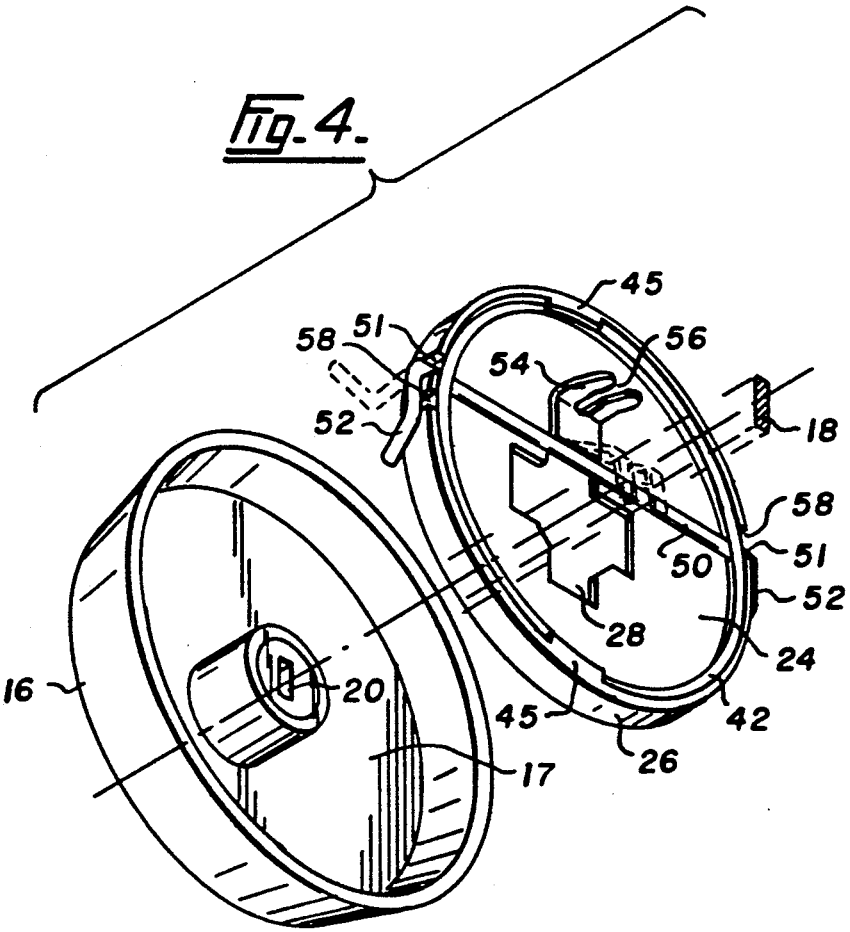

In the embodiment of the invention illustrated in FIGS. 3 and 4, in which parts which are the same as those as FIGS. 1 and 2 are indicated by the same reference numerals, the slide member 32 and the cutouts 30 in the skirt 26 are omitted.

Instead, a spindle 50 is rotatably supported, at opposite ends thereof, in U-shaped openings 51 formed in the skirt 26, the end portions of the spindle 50 being bent to form finger grips or handles 52 by means of which the spindle 50 can be rotated.

At its mid point, the spindle 50 is provided with a locking member 54, made of a piece of bent metal strip, the locking member 54 being formed at its free end with a slot-shaped recess or cutout 56 for receiving the lock tailpiece 18.

In FIG. 4, the locking member 54 is illustrated in full lines in its released position, and in broken lines in its locking position, to which it can be rotated by rotation of the spindle 50 and in which the tailpiece 18 is received into the recess 56, so that the locking member 54 retains the tailpiece 18 against rotation.

Instead of being mounted in the U-shaped openings 51, the spindle may alternatively be inserted into and rotatably mounted in a pair of similar U-shaped openings 58, which are formed in the skirt 26 and spaced from the openings 51. In this way, the lock accessory may be readily adapted for use with locks having tailpieces centrally or co-axially arranged relative to the locks and also with locks having off-centered or non-coaxially arranged tailpieces.

I claim:

1. A lock accessory for a deadbolt lock, said deadbolt lock having an actuating knob, a lock plate with a circular periphery and a tailpiece engaging the actuating knob, said lock accessory comprising:

an intermediate plate for location between the lock plate and a door on which the lock is provided, said intermediate plate having an annular peripheral wall conforming in size to the periphery of the lock plate;

means defining in said intermediate plate an opening through which the tailpiece extends;

manually actuatable locking means mounted on said intermediate plate for selectively preventing and permitting rotation of said tailpiece;

said locking means comprising a locking member movably mounted in said peripheral wall and being displaceable into a first position in which said locking member is in locking engagement with the tailpiece, and a second position in which said locking member is displaced out of locking engagement with the tailpiece, and manually engageable means for effecting the displacement of said locking member between the first and second positions;

said locking member comprising a slide member extending through recesses in said peripheral wall at opposite sides of said intermediate plate, and further comprising an annular spring member extending around the interior of said peripheral wall and bearing resiliently against said slide member for slidably retaining said slide member relative to said intermediate plate, said peripheral wall having inwardly extending means for retaining said annular spring member.

2. A lock accessory for a deadbolt lock, said deadbolt lock having an actuating knob, a lock plate and a tailpiece engaging the actuating knob, said lock accessory comprising:

an intermediate plate for location between the lock plate and a door on which the lock is provided, said intermediate plate having an annular peripheral wall conforming in size to the periphery of the lock plate;

means defining in said intermediate plate an opening through which the tailpiece extends;

manually actuatable locking means mounted on said intermediate plate for selectively preventing and permitting rotation of said tailpiece;

said locking means including;

a rod extending through recesses in said peripheral wall at opposite sides of said intermediate plate;

a lock piece extending from said rod adjacent said tailpiece and having a recess open at one end, means for mounting said rod on said annular peripheral wall at opposite sides of said intermediate plate for axial rotation of said rod whereby axial rotation of said rod to a first position causes the tailpiece to be received in said recess and axial rotation of said rod to a second position disengages the tailpiece from the recess, and manually engageable means at the exterior of said annular peripheral wall for effecting axial rotation of said rod between the first and second positions.

3. A lock accessory as claimed in claim 2 further comprising an annular spring member extending around the interior of said annular peripheral wall and bearing resiliently against said rod for slidably retaining said rod relative to said intermediate plate, said peripheral wall having inwardly extending means for retaining said annular spring member.

* * * * *